United States Patent [19]

Hidding

[11] Patent Number: 4,821,913

[45] Date of Patent: Apr. 18, 1989

[54] TAMPER EVIDENT COVER

[76] Inventor: Daniel P. Hidding, Rte. 2, Ridgecroft La., Barrington Hills, Ill. 60010

[21] Appl. No.: 179,394

[22] Filed: Apr. 8, 1988

[51] Int. Cl.[4] ..... B65D 41/48

[52] U.S. Cl. ..... 220/270

[58] Field of Search ..... 220/270; 222/182; 215/254

[56] References Cited

U.S. PATENT DOCUMENTS

| | | | |
|---|---|---|---|
| 3,102,658 | 9/1963 | Rosen | 220/270 |
| 3,149,745 | 9/1964 | Edelstone et al. . | |
| 3,480,184 | 11/1969 | Landis | 222/153 |
| 3,544,023 | 12/1970 | Hendrickson et al. . | |
| 3,722,729 | 3/1973 | Yamada | 215/254 |
| 4,326,649 | 4/1982 | Marino et al. | 222/182 |

*Primary Examiner*—Donald F. Norton

*Attorney, Agent, or Firm*—Lee & Smith

[57] ABSTRACT

A tamper evident closure for a can such as a spray can is provided with a frangible pull-tab which extends upwardly into the cover from the base and has an outwardly extending grip member which extends along the pull-tab for a sufficient distance to permit initial outward pulling and tearing of the pull-tab along the frangible lines as the grip member is pivoted upwardly. The pull-tab is tapered at its upper end to facilitate removal.

3 Claims, 1 Drawing Sheet

TAMPER EVIDENT COVER

BACKGROUND OF THE INVENTION

This invention relates to a cover for a container, such as an aerosol container, for preventing dust and other contaminants from contacting the dispensing mechanisms and possibly the contents of the container. More particularly the invention relates to a tamper-evidencing cover which may be removed initially only by breaking a seal to evidence the fact of such initial removal.

Tamper evident covers have come into wide use especially for food products and the like to assure ultimate purchasers that the contents and product-dispensing parts of the container have remained inviolate and free of contamination after the filling of the container by the manufacturer. There have been many proposals for such tamper evident covers. One of these is disclosed in my application Ser. No. 017,862 filed Feb. 24, 1987, now U.S. Pat. No. 4,744,483, which features a separate frangible ring shaped to encircle the base of the cover for maintaining the inwardly extending flange of the base in its locking position under the head of the container top closure. While the design is an excellent one, it is costly to produce.

Other prior art devices have included pull-tabs in the sidewall of the cover with a gripping member requiring the pull-tab to be removed by pulling downwardly. The problem with such a design is that it is difficult to start tearing of the pull-tab with a pulling action and the frangible lines thus have to be so thin in such a design that they result in discontinuities. Thus they do not tightly seal the top of the container.

The present invention provides a tamper evident cover which is completely imperforate throughout its structure providing a tight seal for the container top. The cover is inexpensive to produce and may easily be torn frangible lines which may be clearly seen and which will permit the cover to be easily removed from the container. The design provides a leveraged initial tearing along the frangible lines of the pull-tab and the initial tearing may be accomplished by pushing up or pulling on the pull-tab.

SUMMARY OF THE INVENTION

The present invention is used with a can having a top closure with the surrounding outwardly extending bead and a nozzle which extends upwardly through the closure for discharging the contents of the can therethrough. The hollow cap of this invention covers and accommodates therewithin the discharge nozzle. The cap has an open, generally circular base portion, a top portion spaced from the base portion and a tapered side wall portion extending between the base portion and the top portion. The base portion is adapted to surround the spray can top closure bead and has an inwardly extending locking flange for extending under and engaging the closure bead, thereby locking the cap onto the top closure.

An elongated, removable pull-tab is formed in the base and sidwall portions and extends from the base portion upwardly toward the top portion along frangible lines defining the sides of the pull-tab. The pull-tab has an integral grip member at the base portion so that the pull tab may be easily removed and the base portion and adjacent sidwall portion may be spread to permit removal of the inwardly extending base flange from the closure bead. There are no disontinuities along the frangible lines of the removable pull-tab, and the pull-tab is preferably tapered at its upper end with the frangible lines defining the sides of the pull tab substantially intersecting at the upper end of the pull-tab remote from the base portion. This facilitates removal of the pull tab and permits spreading of the lower portion of the cap including the base portion from a single point in the side wall above the base portion.

The grip member is preferably so designed that by merely pushing on it the tearing of the integral pull-tab along the frangible lines maybe initiated. For this purpose the grip member has a leg portion which extends radially outwardly from the pull-tab and where it connects with the pull-tab extends axially along the pull tab for a sufficient distance to provide leverage and permit the outward pulling and initial tearing of the pull tab along the frangible lines when the outer end of the leg portion is swung upwardly, thereby facilitating the removal of the pull-tab. At the end of the leg portion there is preferably a substantially flat tip portion which extends transversely to the outer end of the leg portion and preferably at an obtuse angle with respect to the plane of the cap base portion so that by merely pressing upwardly on the flat tip portion the leg portion will be pivoted upwardly, thereby effectively swinging the bottom end of the pull-tab away from the base and initiating the tearing along the frangible lines at the bottom of the pull-tab. It is prefered that the base portion inwardly-extending flange be interrupted in the area of the pull-tab, and it is further preferred that the base portion be of greater thickness than the sidewall portion except in the area of a pull-tab. This provides greater stiffness for holding the base portion flange in place under the outwardly extending closure bead both before and after removal of the pull-tab.

BRIEF DESCRIPTION OF THE DRAWINGS

The invention is described in greater detail in the following description of examples embodying the best mode of the invention, taken in conjunction with the drawing figures, in which.

DETAILED DESCRIPTION OF THE PREFERRED EMBODIMENT OF THE INVENTION

Figure 1:
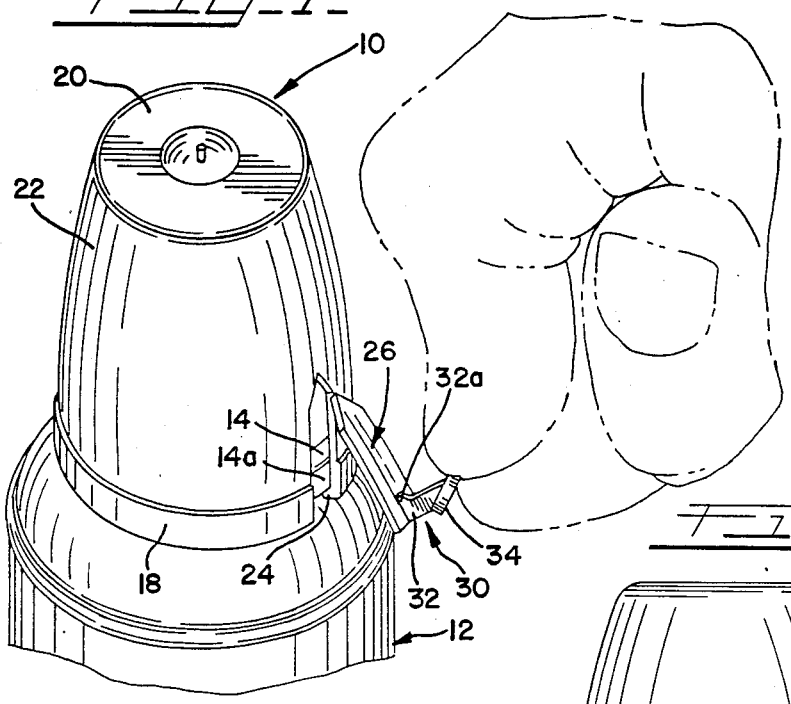
FIG. 1 is a perspective view of a cap constructed in accordance with this invention, showing the cap on a container and immediately after the pull-tab has been removed.
Figure 2:
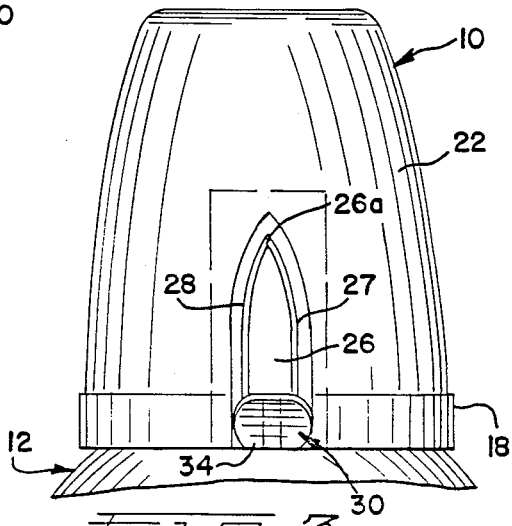
FIG. 2 is front elevational view of the cap constructed in accordance with this invention prior to removal of the pull-tab.

The tamper evident cover or cap 10 is shown in FIG. 1 as being applied to a can 12 such as an aerosol can, having a top closure 14 with an outwardly extending bead **14*a*. A nozzle or other product dispensing structure 16** extends upwardly through the closure and permits discharging of the contents of the can therethrough.

The disclosed cap is hollow for covering and accomodating therewithin the spray can nozzle 16. The cap has an open, generally circular base portion 18, a top portion 20, spaced from the base and an upwardly tapered sidewall portion 22 which extends between the base portion and the top portion. The base portion is adapted to surround the spray can top closure bead and has an inwardly extending flange 24 which extends under and engages the closure bead 14*a*, thereby holding the cap 10 tightly on the top closure of the can. The base portion 18 is preferably thicker than the remainder of the cap thereby serving to reinforce the holding of the inwardly extending flange 24 under the bead 14*a* of the can top closure 14*a*.

An elongated removable pull-tab 26 is formed in and as a part of the base portion 18 and the sidewall portion 22 of the cap, with frangible lines 27 and 28 defining the sides of the pull-tab 26. In the lower portion of the pull-tab the frangible lines 27 and 28 are parallel to one another, and these lines taper toward one another to substantially intersect at the upper end 26*a* of the pull-tab. Thus the pull-tab is in effect tapered substantially to a point at its upper end this facilitates its removal from the sidewall 22 of a cap.

Figure 4:
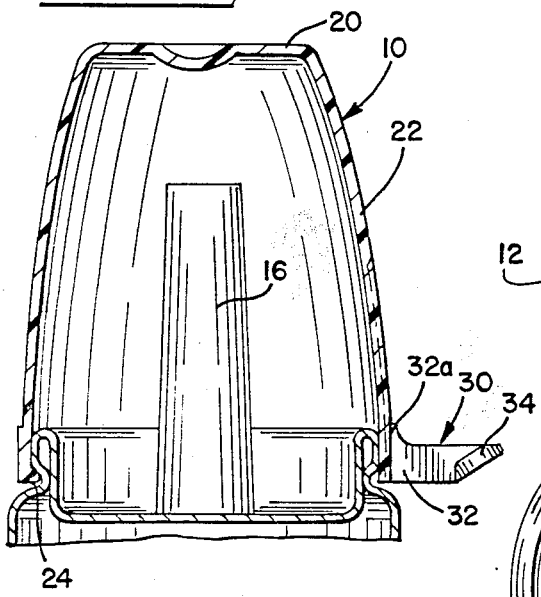
FIG. 4 is a cross-sectional elevational view of the cap taken substantially through the pull-tab.
Figure 3:
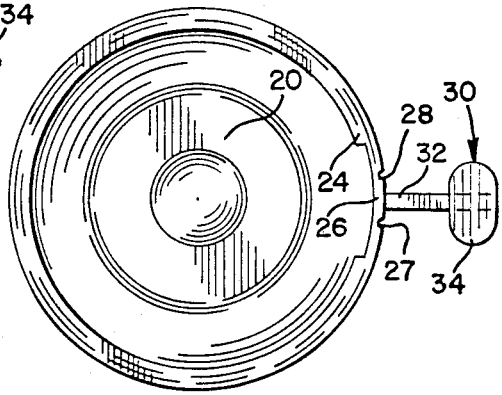
FIG. 3 is a bottom plan view of the cap of this invention.

Integral with the pull-tab 26 at the base portion is a grip member 30 having a leg portion 32 and a tip portion 34. The leg portion 32 extends radially outwardly from the pull-tab 26, and at its inner end where it connects with the pull-tab it extends along the longitudinal axis of the pull-tab for approximately the height of the cap base portion 18. This is best seen in FIG. 4. The inner end of the leg portion actually has a toe 32*a* extending upwardly along the pull tab. This toe 32*a* of the leg portion serves as a fulcrum, as will be described. The tip portion of the grip member is substantially flat and preferably extends at an obtuse angle with respect to the plane of a cap base portion. It will also be noted from FIGS. 3 and 4 that the inwardly extending flange 24 of the cap base portion is interrupted or discontinuous in the area of the pull-tab. This facilitates the initiation of the tearing of the pull-tab.

The cap with the pull-tab in place is initially fored onto the top closure of the can, and the inwardly extending flange 24 is snapped in place beneath the outwardly extending bead 14*a* of the closure. When the purchaser receives th can with the cap in place, the pull-tab may be easily removed along the frangible lines 27 and 28. The initial tearing along the frangible lines 27 and 28 is readily accomplished by merely pressing upwardly on the flat tip portion 34 of the grip member 30 which is aided by the angular disposition of the tip portion. This will cause the leg portion 32 of the grip member to pivot about the toe 32*a* pulling the bottom portion of the leg outwardly and pulling with it the bottom portion of the pull-tab 26 to which it is connected. This will cause initial tearing of the pull-tab along the bottom ends of the frangible lines 27 and 28. Once the initial tearing has begun, the pull-tab may be easily removed by gripping the grip member between the two fingers and pulled upwardly tearing the pull tab along the remainder of the frangible lines 27 and 28 until the pull-tab is finally fully disconnected at its upward point 26*a* where the frangible lines 27 and 28 intersect. Thus the pull-tab may be fully removed as shown in FIG. 1. This will permit the base portion 18 and lower portion of the sidewall 22 to be expanded so that the inwardly extending flange 24 may be disengaged from under the outwardly extending bead 14*a* of the top closure 14 of the can.

It may be seen that with the cover of the present invention there is a tight seal with the top of the can and there are no discontinuities. The design of the grip member provides a leveraged initial tearing along the frangible lines 27 and 28 facilitated by the substantially flat tip which merely has to be pressed to effect the fracture without any initial pulling. The frangible lines thus need not be as thin as would otherwise be required in order to initiate the tearing action.

The foregoing description has been given only by way of example and it will be apparent to those skilled in the art that modifications may be made in the disclosed structure without departing from the scope and true spirit of the invention as hereinafter claimed.

What is claimed is:

1. For use with a can having a top closure with a surrounding outwardly extending bead and a nozzle extending upwardly through the closure for discharging the contents of the can therethrough, a hollow cap for covering the closure and accommodating the nozzle therewithin, said cap having an open generally circular base portion, a top portion spaced from said base and a sidewall portion extending between said base portion and said top portion, said base portion being adapted to surround the spray can top closure bead and having an inwardly extending flange for engaging the closure bead and holding the cap onto the top closure, and an elongated removable pull-tab formed in said base and sidewall portions and extending from said base portion toward said top along frangible lines defining the sides of said pull-tab portion, said cap sidewall portion being tapered from said base portion to said top portion and being continuous and without discontinuities along the frangible side lines of said removable pull-tab, said pull-tab having an integral grip member at said base portion, the frangible lines defining the sides of said pull-tab angling toward each other and substantially intersecting at the end of the pull tab remote from said base portion and from said grip member, said pull-tab grip member having a leg portion extending outwardly from said pull-tab intermediate said frangible lines and extending axially along said pull-tab for a sufficient distance to provide a fulcrum permitting outward pulling and initial tearing of said pull-tab along said frangible lines when the outer end of said leg portion is moved upwardly, and said grip member having a substantially flat tip portion integral with and extending transversely to the outer end of said leg portion to facilitate manual upward movement of the outer end of said leg portion, whereby said pull-tab may be easily removed and said base portion and adjacent sidewall portion may be spread to permit removal of said inwardly extending base portion flange from the closure bead.

2. The structure of claim 1 wherein said grip member tip portion extends at an obtuse angle with respect to the plane of said cap base portion.

3. For use with a can having a top closure with a surrounding outwardly extending bead and a nozzle extending upwardly through the closure for discharging the contents of the can therethrough, a hollow cap for covering the closure and accommodating the nozzle therewithin, said cap having an open generally circular base portion, a top portion spaced from said base portion and a sidewall portion extending between said base portion and said top portion, said base portion being adapted to surround the spray can top closure bead and having an inwardly extending flange for engaging the closure bead and holding the cap onto the top closure, and an elongated removable pull-tab formed in said base and sidewall portions and extending from said base portion toward said top along frangible lines defining the sides of said pull-tab portion, said pull-tab having an integral grip member at said base portion, said pull-tab grip member having a leg portion extending outwardly from said pull-tab and extending axially along said pull-tab for a sufficient distance to permit outward pulling and initial tearing of said pull-tab along said frangible lines when the outer end of said leg portion is moved upwardly, said grip member further having a substantially flat tip portion integral with and extending transversely to the outer end of said leg portion, to facilitate manual upward movement of the outer end of said leg portion, said grip member tip portion extending at an obtuse angle with respect to the plane of said cap base portion, whereby said pull-tab may be easily removed and said base portion and adjacent sidewall portion may be spread to permit removal of said inwardly extending base portion flange from the closure bead.

* * * * *